US005736290A

United States Patent [19]

Zillmer

[11] Patent Number: 5,736,290

[45] Date of Patent: Apr. 7, 1998

[54] NON-AZEOTROPIC SOLVENT COMPOSITION AND METHOD OF USING SAME FOR VAPOR-FREEZING IMAGES FORMED OF POWDER TONER ON A RECORDING CARRIER

[76] Inventor: Jeff Zillmer, 10818 Graeloch Rd., Laurel, Md. 20723

[21] Appl. No.: 625,301

[22] Filed: Apr. 1, 1996

[51] Int. Cl.[6] ..... G03G 13/20

[52] U.S. Cl. ..... 430/124

[58] Field of Search ..... 430/124

[56] References Cited

U.S. PATENT DOCUMENTS

| | | | |
|---|---|---|---|
| 2,726,166 | 12/1955 | Greaves | 430/124 |
| 3,792,488 | 2/1974 | Katakabe . | |
| 4,264,304 | 4/1981 | Hausmann | 432/59 |
| 4,311,723 | 1/1982 | Mugrauer | 427/335 |
| 5,039,442 | 8/1991 | Swan et al. | 252/171 |
| 5,143,754 | 9/1992 | Long et al. | 427/335 |
| 5,333,042 | 7/1994 | Brennan et al. | 430/124 |

FOREIGN PATENT DOCUMENTS

| | | |
|---|---|---|
| 0 465 037 A1 | 6/1991 | European Pat. Off. . |

*Primary Examiner*—Roland Martin
*Attorney, Agent, or Firm*—Browdy and Neimark

[57] ABSTRACT

A non-azeotropic solvent blend having a hydrochlorofluorocarbon, an alkanol and methylene chloride and/or acetone and a method of using same for vapor fixing of toner images in a cold fusion printing system.

6 Claims, 2 Drawing Sheets

NON-AZEOTROPIC SOLVENT COMPOSITION AND METHOD OF USING SAME FOR VAPOR-FREEZING IMAGES FORMED OF POWDER TONER ON A RECORDING CARRIER

BACKGROUND OF THE INVENTION

1. Field of the Invention

The present invention relates to a non-azeotropic solvent composition and a method for using this solvent composition to vapor fix toner images.

2. Description of Related Art

Non-mechanical printers and copiers which operate on the electrostatic principle are well-known in the art. Images are formed of powder toner on a recording carrier medium such as a paper web, by first producing charged images electrographically onto a photo-electric subcarrier, e.g., a drum, and these images are then developed with toner so that the toner images can be subsequently transferred to a recording carrier medium, e.g., paper web, to be visualized. In order to preserve the toner images on the recording carrier medium without smearing, the toner must be subsequently fused onto the recording carrier medium.

Conventionally, the fusion of toner to create a permanent image on paper is performed by either a heat fusing station in a hot fusion laser printing system or a vapor fixing station in a cold fusion laser printing system. In a heat fusing station, a heated roller assembly typically presses the powder toner having a synthetic resin base into the paper to permanently fuse the toner into the paper by heat. A vapor fixing station, in contrast, fixes the toner by exposing it to the solvent vapor which liquefies and fuses the toner so that it penetrates into the paper to form a permanent non-smearing image.

Solvent vapors of methylene chloride have been conventionally used to fuse toners as disclosed in Katakabe, U.S. Pat. No. 3,792,488, and in Long et al., U.S. Pat. No. 5,143,754. However, methylene chloride, as a solvent for fusing toner images in a cold fusion printing system, presents the disadvantages of toxicity and flammability as well as being unsuitable in more recent cold fusion printing systems with fixing stations sensitive sensors. The methylene chloride has a tendency to foul or corrode the sensors, requiring their frequent replacement.

Greaves, U.S. Pat. No. 2,726,166, and Mugrauer, U.S. Pat. No. 4,311,723, reported the use of a solvent composition comprising a chlorofluorocarbon (CFC) and methylene chloride in a method of vapor fixing a toner. CFCs have the disadvantage high ozone depletion potentials (ODP). The Montreal Protocol, to which the United States is signatory, seeks to control the use of compounds which contribute significantly to the depletion of the ozone layer in the upper atmosphere and as a result, CFC compounds have recently become restricted and will soon be banned outright.

As expected, solvent substitutes of CFC for use in a variety of industrial applications have been and are still being developed. Hydrochlorofluorocarbons (HCFCs), which have much lower ODP than exhibited by CFCs, are now being used as CFC substitutes until such time that certain HCFC compounds having measurable ODP are themselves restricted or banned. Such a HCFC, 1,1-dichloro-1-fluoroethane (HCFC-141b), is disclosed in Brennan et al., U.S. Pat. No. 5,333,042, as being a suitable solvent for fusing toner in a cold fusion printing system. Brennan et al. also discloses azeotropic or azeotropic-like solvent blends which may be suitable as a toner fusing agent/solvent. One of the azeotropic solvent compositions disclosed by Brennan et al. as being suitable for use as a toner fusing agent/solvent contains 1,1-dichloro-1-fluoroethane, dichloromethane, and, optionally, an alkanol as originally disclosed in Swan et al., U.S. Pat. No. 5,039,442.

The Swan et al. U.S. Pat. No. 5,039,442 reference cited by Brennan discloses a stable azeotropic-like composition for use in a variety of industrial cleaning applications, or as a blowing agent, and which consists essentially of about 79.6 to 99.95 weight percent HCFC-141b, about 0.05 to 15.9 weight percent dichloromethane, and, optionally, about 0 to 4.5 weight percent alkanol.

Similarly, Swan et al., WO 93/16163 and WO 93/02228, disclose azeotropic-like compositions which not only include HCFC-141b, dichloromethane and, optionally, methanol or ethanol, but also include alkanes, chloropropane, nitromethane, etc. Other azeotropic HCFC-141b-containing compositions, for use in cleaning and as foaming agents, are disclosed in JP 5178767 and EP 474528.

A liquid solvent composition is disclosed in EP 0465037 which includes (a) a fluorine-free organic liquid, (b) a perfluorinated organic liquid, and (c) a co-solvent which is miscible with components (a) and (b). HCFC candidates for co-solvent component (c) include HCFC-141b and HCFC-123.

Previously, the solvent fusing agent used in the vapor fixing station of Hausmann, U.S. Pat. No. 4,264,304, which is an embodiment of the preferred vapor fixing station used for the present invention, was a CFC-containing azeotropic solvent mixture such as that disclosed in Mugrauer, U.S. Pat. No. 4,311,723. This high ozone depleting solvent fusing agent has now been replaced in the marketplace with HCFC-141b as the sole fusing agent (see Brennan et al., U.S. Pat. No. 5,333,042). However, when HCFC-141b is used as the sole fusing agent in the vapor fixing station of Hausmann, the vapor cloud is not effectively contained in the fixing zone and has the disadvantage of allowing HCFC-141b vapors to escape from the fixing station into the outside environment.

Citation of any document herein is not intended as an admission that such document is pertinent prior art, or considered material to the patentability of any claim of the present application. Any statement as to content or a date of any document is based on the information available to applicant at the time of filing and does not constitute an admission as to the correctness of such a statement.

SUMMARY OF THE INVENTION

It is, accordingly, an object of the present invention to overcome the deficiencies of the prior art, such as noted above.

Another object of the present invention to provide a more effective non-CFC containing solvent composition for vapor fixing of toner in a cold fusion printing system.

A further object of the present invention is to provide a method of using the solvent composition of the present invention for improved vapor fixing of toner images.

The present invention relates to a non-azeotropic solvent composition, which includes a hydrochlorofluorocarbon, a solvent, such as methylene chloride and/or acetone, and an alkanol, for improved vapor fixing of images formed of powder toner on a recording carrier medium.

The present invention also relates to a method of using the azeotropic solvent composition for vapor fixing of toner images in a fusing/fixing station having a fixing zone and a cooling zone where the cooling zone is cooled with a refrigerant which not only condenses vapors leaving the fixing zone and thereby prevents vapors from escaping into the outside environment, but also advantageously reduces the size of the fixing zone.

DETAILED DESCRIPTION OF THE EMBODIMENTS

The method for vapor fixing of toner onto a medium in a cold fusion printing process may be implemented within the Siemens Nixdorf Model 2200 Laser Printing System, manufactured by Siemens Nixdorf Printing Systems, Inc., Boca Raton, Fla. Such a printing system is disclosed in: Siemens 2200 Operator Training Manual (1985); Siemens Printing System, 2200 Model 2, Operating Manual (December 1984); Siemens Laser Printer ND3 RFC, Maintenance Manual (1987); Siemens Laser Printer ND3C/2200, Parts Catalog (1987); and 6100 Student Guide, STC Canada, Inc. (1985), all of which are incorporated herein by reference. Non-limiting examples of other cold fusion laser printing systems that are equivalent, if not nearly identical, to the Siemens Nixdorf Model 2200 are the Storage Tek 6100, manufactured by Storage Tek of Melbourne, Fla., and cold fusion laser printing systems manufactured almost in their entirety by Siemens Nixdorf Printing Systems but distributed by AT&T of Atlanta, Ga., under the following brand and model names, Datagraphics 6800 and NCR 6480.

Figure 1:
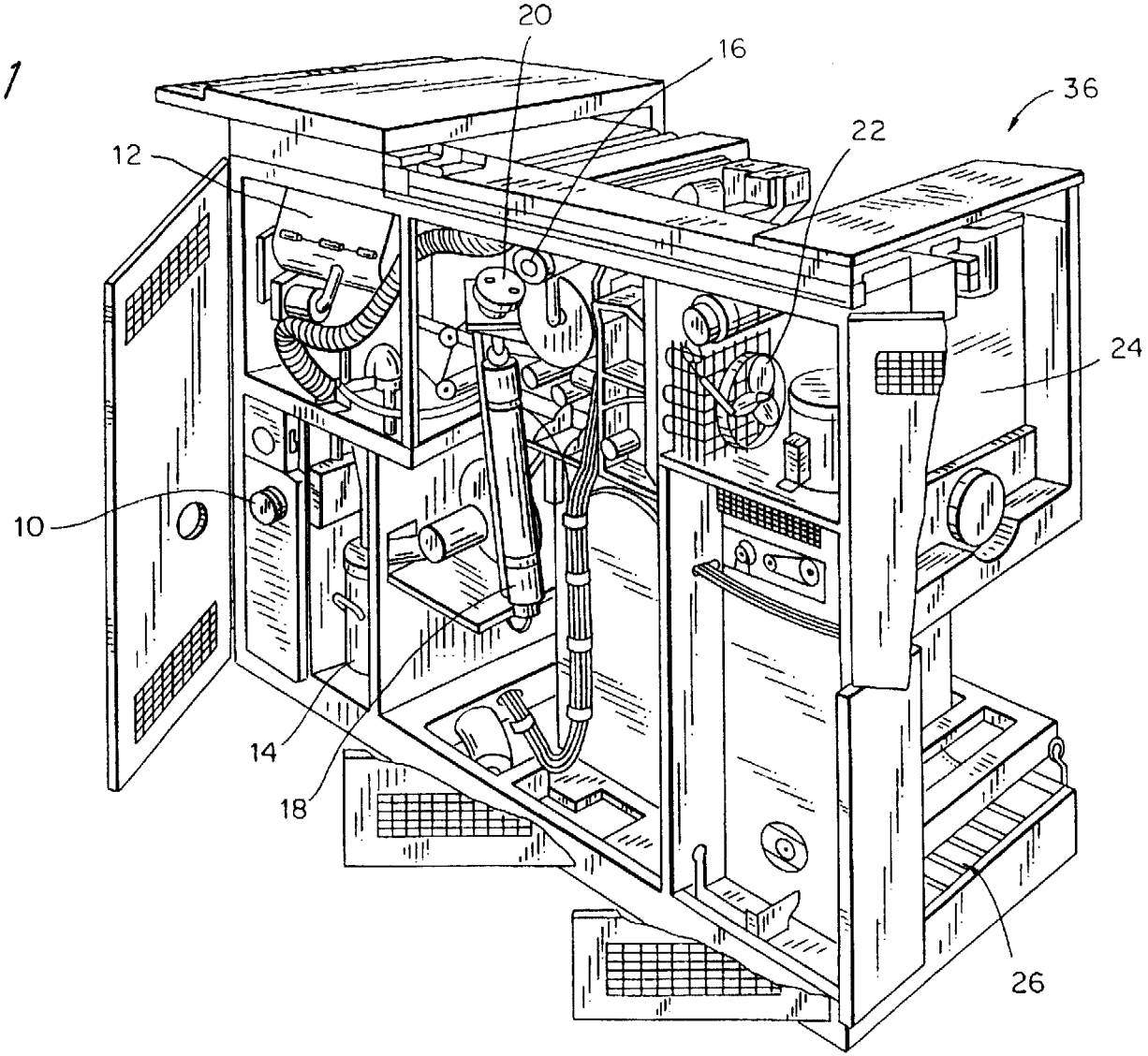
FIG. 1 shows an example of a cold fusion printing device with a fusing station containing the solvent composition as used in accordance with the present invention.

Referring to FIG. 1, a Siemens Nixdorf Model 2200 Laser Printing System is generally illustrated. The cold fusion printing system 36 possesses a main power switch 10, a toner reservoir 12, a toner collection container 14, a main motor 16, a laser 18, a laser optics assembly 20, a cooling assembly 22, a cold fusing station 24, and a forms stacker 26.

Figures 2, 3:
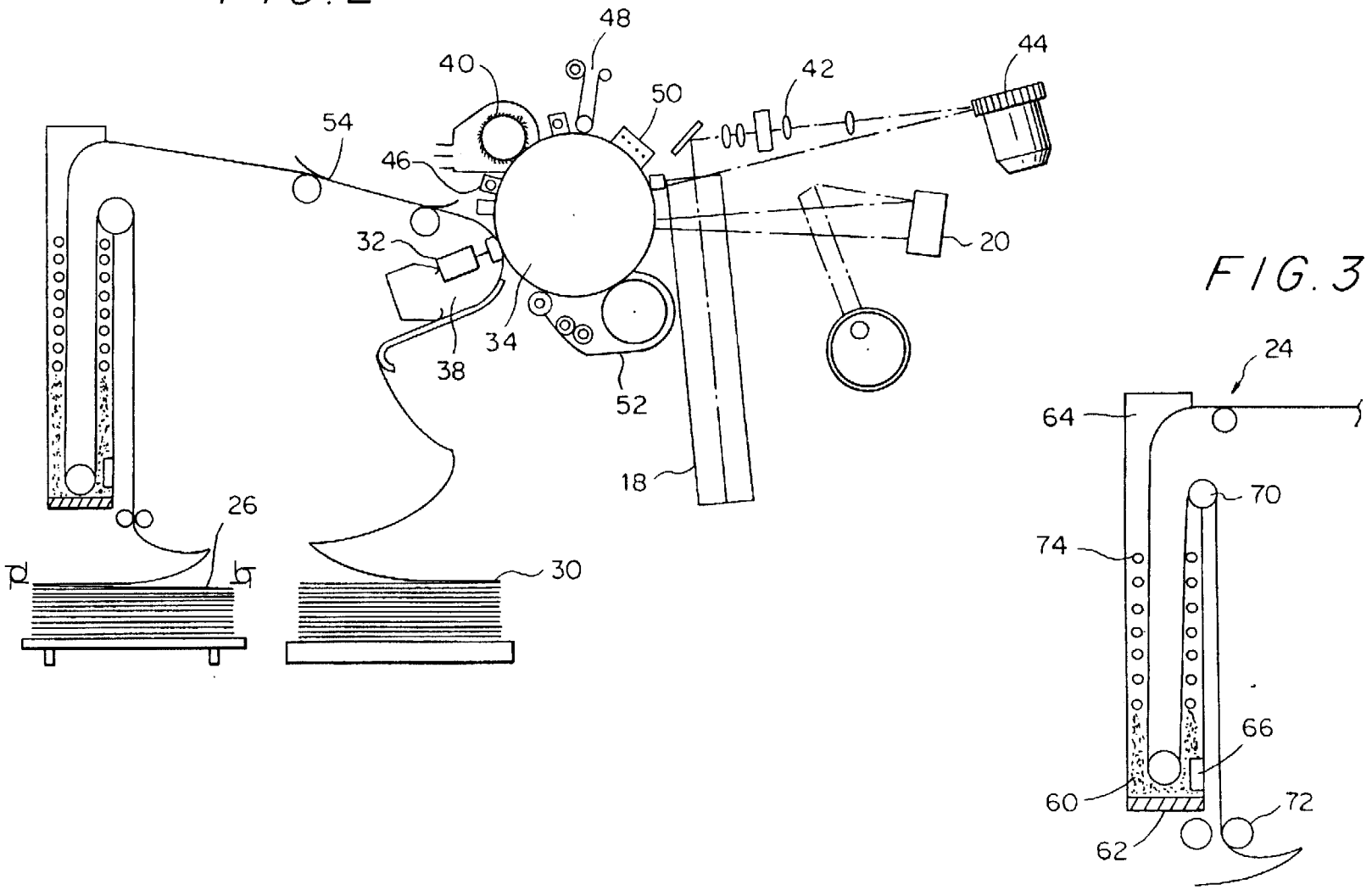
FIG. 2 shows a cross-sectional view of a cold fusion printing system.
FIG. 3 shows a cross-sectional view of a cold fusing station.

Referring to FIG. 2, a cross-sectional view of the aforementioned cold fusion printing system 36 in which the present invention is to be implemented is illustrated. The printing system 36 undertakes three basic steps to produce printed matter on paper. These three steps are character generation, character transfer, and cold fusion of characters.

The printing system 36 begins the printing process after retrieving a blank sheet of paper from the forms input tray 30, and transferring the paper to an input station 38. The input station 38 leads the paper to a position adjacent to a photo-conductive drum 34. While the present invention is described using a paper medium as the recording carrier, other suitable media may also be employed with satisfactory results.

Character generation is achieved by forming characters on the photo-sensitive drum 34. Initially, the surface of the rotating photo-sensitive drum 34 is charged to a positive polarity by means of a charge corotron 50. Subsequently, the laser 18, in conjunction with an acousto-optical deflection system 42, a polygon mirror 44 and the laser optics assembly 20, selectively forms characters upon selected portions of the surface of drum 34 by erasing the charge in image (character) areas. Thus, only the areas occupied by laser generated characters have a neutral polarity upon the drum 34, and the remaining area of this drum 34 remains positively polarized.

Continuous rows of dots are formed on the rotating drum 34 creating a representation of the character to be printed. As will be appreciated by one skilled in the art, "character" as used in this context refers to any graphic figure, expression, representation, image, or any part thereof which is generated on the polarized drum. The drum 34 is rotated in the direction shown by arrow 51, past a developer station 52 which contains a fine dyed-black plastic powder, generally referred to as toner and preferably having a polystyrene base. The toner is positively charged and applied across the width of the rotating drum 34 by the developer station 52. The toner, possessing a positive charge, is repelled into the erased areas of the drum 34 to represent the character that will be printed. This process is well known to the art. See Mugrauer, U.S. Pat. No. 4,311,723 which is incorporated herein by reference.

Character transfer occurs as the paper, which is energized with a very strong negative charge, rotates past the transfer station 32. The transfer is accomplished since the charge differential between the charged paper and the toner is so significant that the toner is attracted from the surface of the drum 34 to the paper. The toner is held to the paper only by the charge difference, and at this stage could be blown or brushed off the paper. As will be explained in more detail below, a cold fusion step is subsequently performed to cause the toner to adhere more securely to the paper medium.

The drum 34 is then rotated past a discharging corotron 46 which discharges the positively polarized areas of the drum 34. Thereafter, a cleaning brush 40 and cleaning fleece 48 remove excess toner for recycling and electrically clean the drum 34. Subsequently, the charge corotron 50 electrostatically charges the surface of the drum 34 with a positive charge. The aforementioned steps are then repeated for a subsequent printing.

Upon completion of character transfer, the paper is transported by means of a paper transport mechanism 54 to the cold fusing station 24. The process of fusing the toner to the paper is accomplished by two steps within the cold fusion station: (i) a vapor bath and (ii) cold fusion of the characters.

Referring to FIG. 3, a cross-sectional view of the cold fusing station 24 is illustrated. See Hausmann, U.S. Pat. No. 4,264,304, the teachings of which are herein incorporated by reference. A vapor bath is created by confining a non-azeotropic solvent composition 60 as a toner fusing agent according to the present invention. A vapor cloud is generated by a thermo-resistively controlled hot plate 62, which takes advantage of the low boiling point of the non-azeotropic solvent mixture. The vapor cloud is generally confined within a fixing zone in a fusing chamber 64 by a chilled air interface that is developed by a set of condensing coils 74 which are disposed above the fixing zone. The density of the vapor cloud is controlled by measuring the impenetrability of the cloud by an ultrasonic sensor 66. The non-azeotropic solvent mixture 60 is then introduced, dependent on the measured density of the cloud, into the system by droplets that are emitted onto the surface of the hot plate 62. The droplets of non-azeotropic solvent mixture are, in turn, vaporized to increase the density of the confined cloud and raise the concentration of solvent vapors in the vapor cloud.

Cold fusion of the characters is produced by transporting the paper through the solvent vapor cloud. The solvicity characteristics of the solvents in the non-azeotropic solvent composition 60 liquifies the toner which is then absorbed by the paper. The evaporation rate of the solvents in the non-azeotropic mixture 60 insures that the toner is fixed to the paper and becomes smear-free when the paper exits the cold fusion chamber 64 by means of the deflection roller 70. Thereafter, it passes through a set of exit rolls 72 and onto the forms stacker 26.

The solvent composition for use as the toner fusing agent is a non-azeotropic blend of between 70 to 95% by volume of a hydrochlorofluorocarbon which is preferably selected from 1,1-dichloro-1-fluoroethane (HCFC-141b), 2,2-dichloro-1,1,1-trifluoroethane (HCFC-123), and a mixture thereof, between 2.5 to 15% by volume of a solvent component which is preferably selected from methylene chloride and/or acetone, and between 2.5 to 15% by volume of an alkanol which is preferably selected from methanol and ethanol. Preferably, the non-azeotropic solvent blend consists essentially of between about 80 to 90% by volume of the selected hydrochlorofluorocarbons, about 5 to 10% by volume of methylene chloride and/or acetone and about 5 to 10% by volume of methanol or ethanol, and most preferably, consists essentially of about 85% by volume of the selected hydrochlorofluorocarbon, about 10% by volume of methylene chloride and/or acetone, and about 5% by volume of methanol or ethanol.

Besides methylene chloride and/or acetone as the preferred solvent component, other suitable solvents are those which have a boiling point in the range of about 90° F. to 175° F., more preferably in the range of about 100° F. to 147° F., and most preferably in the range of about 100° F. to 135° F. Suitable solvents according to the present invention also have the property that when combined with the hydrochlorofluorocarbon, which has a Kauri-Butanol number in the range of about 75 to 85, in the non-azeotropic solvent composition, the overall Kauri-Butanol (KB) number of the non-azeotropic solvent composition would be in the range of about 75–95.

It is intended that each of the hydrochlorofluorocarbon, solvent and alkanol components of the non-azeotropic solvent composition can be a mixture of two compounds, e.g., 1,1-dichloro-1-fluoroethane and 2,2-dichloro-1,1,1-trifluoroethane, in any proportion. Preferably the solvent is a mixture of methylene chloride and acetone and the alkanol is methanol.

The most preferred compositions consist essentially of about 85% by volume of either 2,2-dichloro-1,1,1,1-trifluoroethane, 1,1-dichloro-1-fluoroethane, or a mixture thereof, 10% by volume methylene chloride or a mixture of about 5% by volume methylene chloride and about 5% by volume acetone as the solvent component, and about 5% by volume methanol.

The non-azeotropic solvent composition according to the present invention provides several advantages over the fusing agents previously or currently used for fixing toners in cold fusion printing systems having a vapor fixing station as illustrated in FIG. 3 and also as described in Hausmann, U.S. Pat. No. 4,264,304. One advantage is that the components of the non-azeotropic solvent composition all have little or no ozone depletion potential (ODP). Methylene chloride, acetone, methanol and ethanol have no ODP. The hydrochlorofluorocarbons HCFC-123 and HCFC-141b have an ODP of 0.016 and 0.081, respectively, which is much lower than the 0.8 ODP of the now restricted CFC disclosed in Mugrauer, U.S. Pat. No. 4,311,723. Moreover, the non-azeotropic solvent composition according to the invention, particularly the preferred embodiments containing HCFC-123, HCFC-141b, or a HCFC-123/HCFC-141b mixture, would reduce the ODP of the toner fusing agent and the overall level of ODP compounds used per unit of paper on which toner images are fixed from those currently used in the art.

Besides having a low ODP, the non-azeotropic solvent blend has the desirable properties of being non-flammable, of not forming an explosive mixture and of exhibiting a very low degree of toxicity. Another advantage of the present non-azeotropic solvent composition is that it is capable of significantly increasing the amount of paper processed through a vapor fixing station per unit volume of fusing agent. Table 1 shows the comparative test results of the "foot count" or measure of paper process per half gallon of fusing agent used in the vapor fixing station of a Siemens 2200 Laser Printing System.

TABLE 1

| | Kauri Butanol | | Linear feet of paper printed per unit volume (bottle)[2,3] | |
|---|---|---|---|---|
| Sample[1] | Number | Boiling Pt. | @75° F. | @90° F. |
| 1 | 50 | 110.5° F. | 21,682 | 19,580 |
| 2 | 76 | 85° F. | 23,405 | 19,324 |
| 3 | 82 | 97.6° F. | 26,154 | 25,654 |
| 4 | 90 | 104.5° F. | 28,678 | 28,059 |

Notes for Table 1:
1. The composition of the samples are as follows:
sample 1 = 88.9% CFC-113 + 11.1% acetone
2 = HCFC-141b
3 = 90% HCFC-141b + 5% methylene chloride + 5% methanol
4 = 85% HCFC-141b + 5% methylene chloride + 5% acetone + 5% methanol
2. Tests were performed using a Siemens Model 2200 Laser Printing System at a room and paper temperature of either 75° F. or 90° F. with a hot plate temperature of 170° F. and a condensing coil temperature of −3° F. with GHG refrigerant in the vapor fixing station of FIG. 3.
3. The linear feet of paper printed per unit volume determined in the tests performed were then calculated to a standard bottle volume (0.567 gal) used in the Siemens Nixdorf Model 2200 Laser Printing System.

The degree of solvency or solvicity of a solvent or solvent blend is commonly stated in terms of a Kauri Butanol (KB) number. The Kauri Butanol number or value can be measured by determining the ease of combining a mixture of a Kauri resin and n-butanol as is well known in the art. It is preferred that the non-azeotropic solvent composition have a KB number in the range of about 75–95. Too high a KB number was found to dramatically reduce the life of the ultrasonic sensor used to determine cloud density in vapor fixing stations. Partly for this reason, the amount of methylene chloride and/or acetone should not exceed about 15–20% by volume of the mixture.

A further advantage of the non-azeotropic solvent blend is that the icing on the condensing coils as observed with prior art fusing agents is avoided when used in combination with condenser coils charged with the non-azeotropic refrigerant composition discussed below.

In the method of vapor fixing toner images onto a medium such as paper, a non-azeotropic refrigerant composition of about 55% by weight of chlorodifluoromethane, about 37% by weight chlorodifluoroethane, and about 8% by weight of isobutane, having a boiling point of −22° F. and which is commercially available from Peoples Welding Supply, Inc., W. Lafayette, Ind., as GHG refrigerant, is preferably used as the refrigerant in the condensing coils 74 located above the fixing zone in the fusing chamber 64 of the cold fusing station illustrated in FIG. 3. The use of this refrigerant in the condensing coils is effective in lowering the height of the vapor cloud and reducing the size of the fixing zone, thereby controlling the vapor cloud/chilled air interface at a position well below the condensing coils. This control of the vapor cloud avoids the problem of having the height of the vapor cloud migrate to a point above the lower-most coil of the set of condensing coils as a result of entrainment by the rapid transport of paper from the fixing zone to deflection roller 70. In this manner, the method according to the invention provides not only improved vapor fixing of toner images on a recording medium, e.g. paper, but also overcomes the deficiencies of the prior art, such as the undesirable icing on the condensing oils.

The GHG refrigerant, when used in the set of condensing coils 74 illustrated in FIG. 3, provides a condensing coil temperature of about −3° F. While GHG refrigerant is the most preferred refrigerant for use in the condensing coils of the cold fusion station, other suitable refrigerants capable of maintaining condensing coil temperatures in the range of −10° F. to 5° F. can be used. These suitable refrigerants have boiling points in the range of about −30° F. to −10° F. and are able to easily and repeatedly change between liquid and vapor states while maintaining good stability in either state. Other non-limiting examples of suitable refrigerants include R-406a (a mixture consisting essentially of 55 wt % R-22, 41 wt % R-142b and 4 wt % isobutane) and R-134a. While refrigerants such as R-134a may require a different compressor system from that used with the GHG refrigerant in the condenser coils 74, they are intended to be suitable refrigerants if they have the properties described above.

Having now fully described this invention, it will be appreciated by those skilled in the art that the same can be performed within a wide range of equivalent parameters, concentrations, and conditions without departing from the spirit and scope of the invention and without undue experimentation.

While this invention has been described in connection with the specific embodiments thereof, it will be understood that it is capable of further modifications. This application is intended to cover any variations, uses, or adaptations of the inventions following, in general, the principles of the invention and including such departures from the present disclosure as come within known or customary practice within the art to which the invention pertains and as may be applied to the essential features hereinbefore set forth as follows in the scope of the appended claims.

All references cited herein, including journal articles or abstracts, published or corresponding U.S. or foreign patent applications, issued U.S. or foreign patents, or any other references, are entirely incorporated by reference herein, including all data, tables, figures, and text presented in the cited references. Additionally, the entire contents of the references cited within the references cited herein are also entirely incorporated by reference.

Reference to known method steps, conventional method steps, known methods or conventional methods is not in any way an admission that any aspect, description or embodiment of the present invention is disclosed, taught or suggested in the relevant art.

The foregoing description of the specific embodiments will so fully reveal the general nature of the invention that others can, by applying knowledge within the skill of the art (including the contents of the references cited herein), readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art.

What is claimed is:

1. In the method for vapor fixing of toner onto a medium, comprising the steps of:

generating an image by transferring toner to selected areas of the medium;

forming a vapor cloud from a solvent composition;

transporting the medium through the vapor cloud to fuse the toner to the medium in a fixing zone; and transporting the medium through a cooling zone to condense the vapors of the vapor cloud leaving the fixing zone and thereby preventing escape of the vapors into the environment;

the improvement wherein said solvent composition consists essentially of:

70 to 95% by volume of a hydrochlorofluorocarbon selected from the group consisting of 1,1-dichloro-1-fluoroethane, 2,2-dichloro-1,1,1-trifluoroethane, and mixtures thereof having a Kauri-Butanol number in the range of about 75 to 85;

2.5 to 15% by volume of a solvent having a boiling point in the range of about 100° F. to 147° F. and selected from the group consisting of methylene chloride, acetone, and mixtures thereof, wherein said solvent in combination with said hydrochlorofluorocarbon provides an overall Kauri-Butanol number for the non-azeotropic solvent composition in the range of about 75–95; and 2.5 to 15% by volume of alkanol selected from the group consisting of methanol, ethanol, and mixtures thereof.

2. A method in accordance with claim 1, wherein said solvent is a mixture of methylene chloride and acetone.

3. A method in accordance with claim 1, wherein said solvent is methylene chloride.

4. A method in accordance with claim 1, wherein, in said non-azeotropic solvent composition, said hydrochlorofluorocarbon is about 85% by volume;

said solvent is a mixture of about 5% by volume methylene chloride and about 5% by volume acetone; and said alkanol is about 5% by volume methanol.

5. A method in accordance with claim 1, wherein, in said non-azeotropic solvent composition, said hydrochlorofluorocarbon is about 85% by volume;

said solvent is a mixture of about 10% by volume methylene chloride and about 5% by volume acetone; and said alkanol is about 5% by volume methanol.

6. A method in accordance with claim 1, wherein, in said non-azeotropic solvent composition, said hydrochlorofluorocarbon is about 85% by volume;

said solvent is 10% by volume methylene chloride; and said alkanol is about 5% by volume methanol.

* * * * *